US006281846B1

(12) United States Patent
Puente Baliarda et al.

(10) Patent No.: US 6,281,846 B1
(45) Date of Patent: Aug. 28, 2001

(54) DUAL MULTITRIANGULAR ANTENNAS FOR GSM AND DCS CELLULAR TELEPHONY

(75) Inventors: Carles Puente Baliarda; Jordi Romeu Robert; Monica Navarro Rodero; Carmen Borja Borau; Jaume Anguera Pros, all of Barcelona (ES)

(73) Assignee: Universitat Politecnica de Catalunya (ES)

( * ) Notice: Subject to any disclaimer, the term of this patent is extended or adjusted under 35 U.S.C. 154(b) by 0 days.

(21) Appl. No.: 09/462,211

(22) PCT Filed: May 5, 1999

(86) PCT No.: PCT/ES99/00117

§ 371 Date: Apr. 26, 2000

§ 102(e) Date: Apr. 26, 2000

(87) PCT Pub. No.: WO99/57784

PCT Pub. Date: Nov. 11, 1999

(30) Foreign Application Priority Data

May 6, 1998 (ES) ..... 9800954

(51) Int. Cl.[7] ..... H01Q 1/38
(52) U.S. Cl. ..... 343/700 MS; 373/795
(58) Field of Search ..... 343/700 MS, 795, 343/833, 742

(56) References Cited

U.S. PATENT DOCUMENTS 5,245,474 9/1993 Chabassier et al. ..... 359/578
5,696,372 * 12/1997 Grober et al. ..... 250/216
5,963,871 * 10/1999 Zhinong et al. ..... 455/550
6,002,369 * 12/1999 Richard ..... 343/700 MS
6,057,802 * 5/2000 Nealy et al. ..... 343/700 MS

FOREIGN PATENT DOCUMENTS

2112163 * 3/1998 (ES) .
2658619 8/1991 (FR) .
97/06578 2/1997 (WO) .

OTHER PUBLICATIONS

Y. Kim et al., *The Fractal Random Array Proceedings of the IEEE*, vol. 74, No. 9, Sep. 1986.

* cited by examiner

*Primary Examiner*—Don Wong
*Assistant Examiner*—James Clinger
(74) *Attorney, Agent, or Firm*—Ostrolenk, Faber, Gerb & Soffen, LLP

(57) ABSTRACT

The dual multitriangular antennas of the present invention are mainly used and operate in the base stations of cellular telephony systems working in GSM and DCS bands. They provide radioelectric coverage to any user of one cell which operates in any of the two bands or simultaneously in both bands. The invention provides an antenna having a radiating element comprising basically several triangles exclusively linked by the vertexes thereof Its function is to work simultaneously in bands of the radioelectric spectrum corresponding to 890 MHz–960 MHZ GSM and 1710 MHZ–1880 MHZ DCS cellular telephony systems.

16 Claims, 7 Drawing Sheets

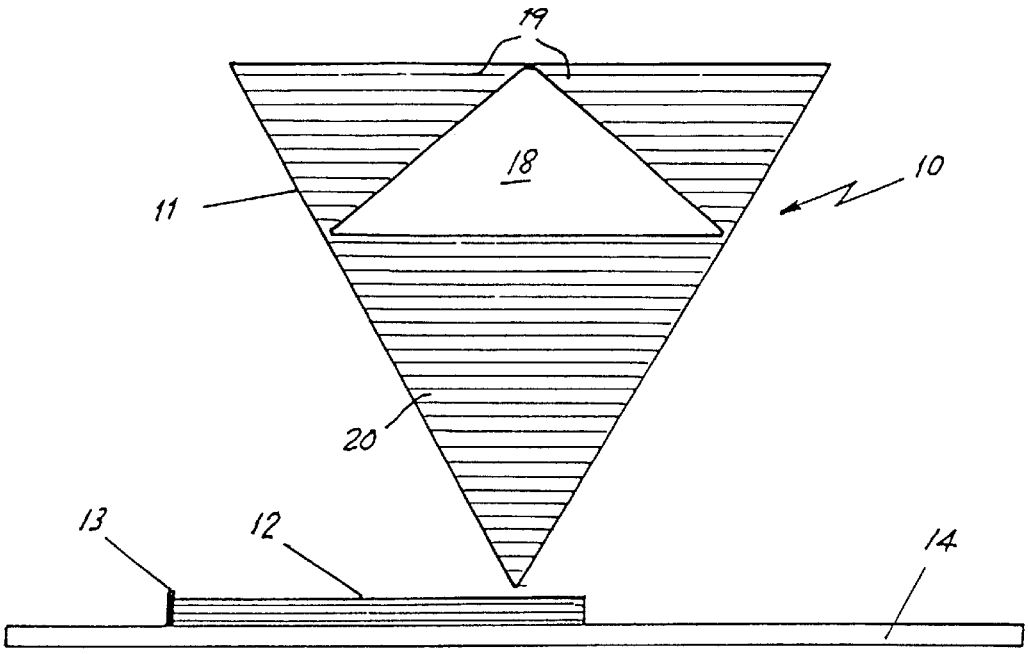
FIG. 1
FIG. 2
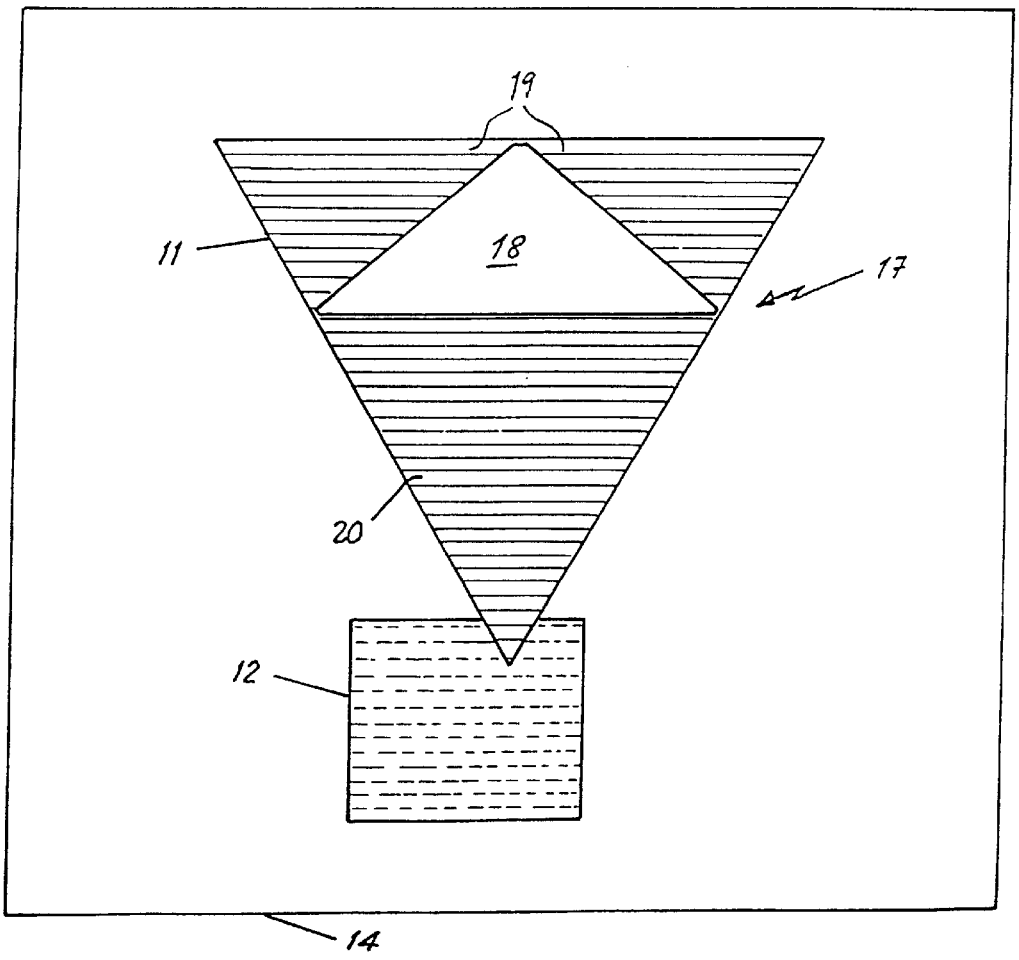

DCS

GSM

DUAL MULTITRIANGULAR ANTENNAS FOR GSM AND DCS CELLULAR TELEPHONY

BACKGROUND OF THE INVENTION

The present patent application relates, as stated in its title, to a "DUAL MULTITRIANGULAR ANTENNAS FOR GSM AND DCS CELLULAR TELEPHONY" having novel manufacturing, conformation and design features that filfil the purpose to which it has been specifically conceived, with maximum safety and effectiveness.

More particularly, the invention refers to antennas comprising a number of triangles linked by the vertexes thereof, which simultaneously cover the GSM cellular telephony bands with frequency 890 MHz–960 MHz and DCS cellular telephony bands with frequency 1710 MHz–1880 MHz.

The antennas started their developing by the end of last century when James C. Maxwell set forth the main laws of electromagnetism in 1864. The invention of the first antenna in 1886 should be attributed to Heinrich Hertz with which he demonstrated the transmission of the electromagnetic waves through the air. In the $20^{th}$ century and at the turn of sixties the early frequency independent antennas can be found (E. C. Jordan, G. A. Deschamps, J. D. Dyson, P. E. Mayes, "Developments in broadband antennas", IEEE Spectrum, vol. 1 pages 58–71, April 1964; V. H. Rumsey, "Frequency-Independent antennas", New York Academic, 1966; R. L. Carrel, "Analysis and design of the log-periodic dipole array", Tech. Rep. 52, university of Illinois Antenna Lab., Contract AF33 (616)-6079, Oct. 1961; P. E. Mayes, "Frequency independent antennas and broad-band derivatives thereof", proc. IEEE, col. 80, number 1, January 1992, and helixes, loops, cones and log-periodic groups were proposed for making broadband antennas. Subsequently fractal or multifractal-type antennas were introduced in 1995 (fractal and multifractal terms should be attributed to B. B. Mandelbrot in his book "The fractal geometry of nature", W. H. Freeman and Cia, 1983). These antennas had a multifrequence performance due to their own shape and, in certain situations, as described and claimed in the U.S. Pat. No. 9,700,048 of the same applicant, they were small sized. The antennas described herein have their primitive origin in said fractal-type antennas.

SUMMARY OF THE INVENTION

The object of the present invention is to provide an antenna which radiating element comprises basically several triangles exclusively linked by the vertexes thereof. Its function is to operate simultaneously in the radioelectric spectrum bands corresponding to 890 MHz–960 MHZ GSM and 1710 MHZ–1880 MHZ DCS cellular telephony systems respectively.

Currently the GSM system is used in Spain by the operators Telefónica (Movistar system) and Airtel. DCS system is expected to become operational halfway through year 1998, the above mentioned operators or other operators being able to apply for a license of operation in the corresponding band within the range of 1710 MHz–1880 MHz.

The dual multitriangular antennas of the present invention (AMD hereafter) are mainly used in the base stations of both cellular telephony systems (GSM and DCS), providing radioelectric coverage to any user of one cell which operates in any of the two bands or simultaneously in both bands. The conventional antennas for GSM and DCS systems operate exclusively in only one band, whereby two antennas are required in case of wanting to provide coverage in both bands within the same cell. Since AMD operate simultaneously in the two bands, it is absolutely unnecessary to use two antennas (one for each band), whereby cellular system establishment cost is reduced and the impact on the environment in the urban and rural landscapes is minimised.

The main features of such antennas are:

Their multitriangular shape comprising three triangles linked by the vertexes thereof together forming, in turn, a larger sized triangular structure.

Their radioelectric performance (input impedance and radiation diagram) which is sufficiently similar in both bands (GSM and DCS) to meet the technical requirements simultaneously for each two systems.

As opposed to other antennas, the multifrequency performance in AMD is obtained by means of a single radiating element: the multitriangular element. This permits to greatly simplify the antenna, thus reducing its cost and size.

The AMD antennas are provided in two versions suitable for two different situations: a first version (hereafter AMD1) with omnidirectional diagram for roof horizontal mounting, and a second version (hereafter AMD2) with sectorial diagram for wall or pipe vertical mounting. In the former case, the multitriangular element is mounted in a monopole configuration on a conductive ground plane, whilst in the latter case the multitriangular element is mounted in a patch-like configuration which is parallel to the conductive ground plane.

The dual multitriangular antennas for cellular telephony comprise three main parts: a conductive multitriangular element, a connection network interconnecting the multitriangular element with the antenna access connector and a conductive ground plane.

The distinctive feature of said antennas is the radiating element made by linking three triangles. The triangles are linked by their vertexes in such a way that altogether are, in turn, triangle shaped. The radiating element is made out of a conductive or superconductor material. By way of example, but not being limited to it, the multitriangular structure can be made out of copper or brass sheet or in the form of a circuit board on a dielectric substrate.

The main task of the connection network is firstly to facilitate the physical interconnection between the multitriangular element and the antenna connector, and secondly to adapt the natural impedance of the multitriangular element to the impedance of the cable (typically 50 Ohm) that interconnects the antenna with the transmitter-receiver system.

The conductive ground plane, along with the multitriangular element, serves the purpose of configuring the antenna to obtain the suitable radiation beam shape. In the AMD1 model, the multitriangular element is mounted perpendicular to the ground plane providing an omnidirectional diagram in the horizontal plane (taking said ground plane as the horizontal reference). The shape of the ground plane is not a determining factor though a circular shape is preferred due to its radial symmetry, which increases omnidirectionability.

In the AMD2 model, the multitriangular element is mounted parallel to the ground plane providing the antenna with a sectorial diagram. In addition, metal flanges can be mounted perpendicular to the ground plane in both side edges. Said flanges help to make the radiating beam narrower in the horizontal plane, reducing its width dimension by increasing the height of the flanges.

Concerning the type of metal to be used, it is not important from a radioelectric standpoint, though in the AMD1 model aluminium will be preferred due to its lightness and good conductivity.

The dual performance of the antenna, i.e. the repetition of its radioelectric features in the GSM and DCS bands is obtained thanks to the characteristic shape of the triangular element. Basically, the frequency of the operative first band is determined by the height of the triangular perimeter of the structure, whilst the frequential position of the second band is determined by the height of the lower solid metallic triangle.

Further details and features of the present invention will be apparent from the following description, which refers to the accompanying drawings that schematically represent the preferred details. These details are given by way of example, which refer to a possible case of practical embodiment, but it is not limited to the disclosed details; therefore this description must be considered from a illustrating point of view and without any type of limitations.

A detailed list of the various parts cited in the present patent application is given below: (10) omnidirectional dual multitriangular antenna, (11) multitriangular radiating element, (12) connection network, (13) connector, (14) ground plane, (15) adaptation network, (16) rigid foam, (17) sectorial dual multitriangular antenna, (18) triangular hole, (19) upper triangles, (20) lower triangle.

BRIEF DESCRIPTION OF THE DRAWINGS

FIG. 1 shows the structure of an AMD1 omnidirectional antenna (10). The antenna is mounted perpendicular to the ground plane (14).

FIG. 2 shows the structure of an AMD2 sectorial antenna (17). The multitriangular radiating element (11), the ground plane (14) and the connection network (12) can be seen in said FIG. 2. The antenna (17) is mounted perpendicular to the horizontal plane (14).

DETAILED DESCRIPTION OF THE DRAWINGS

Two specific operation modes (AMD1 and AMD2) of the dual multitriangular antenna are described below.

Figure 3:
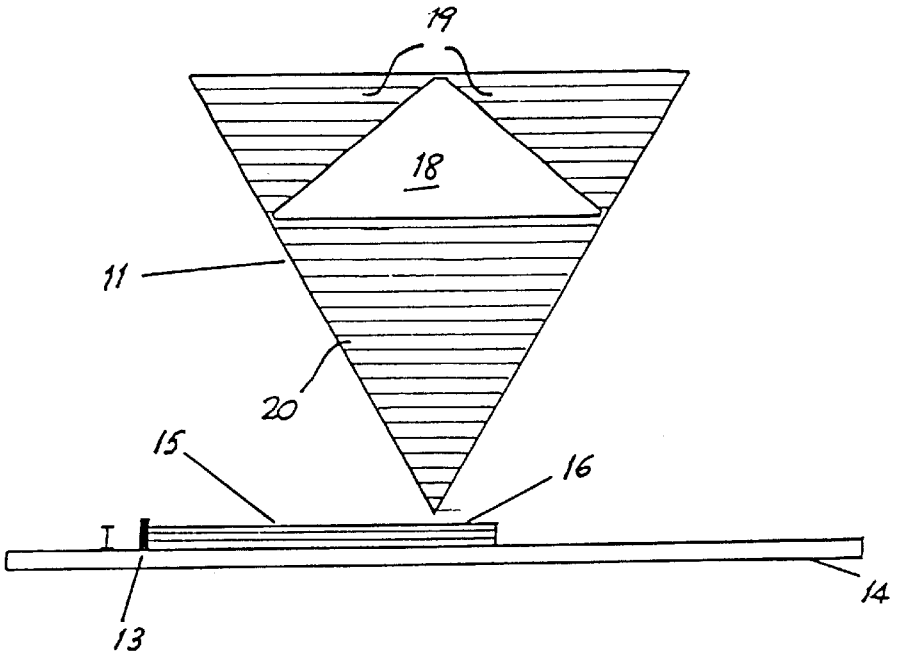
FIG. 3 shows two specific embodiments of the AMD1 and AMD2 antenna models respectively.
Figure 3:
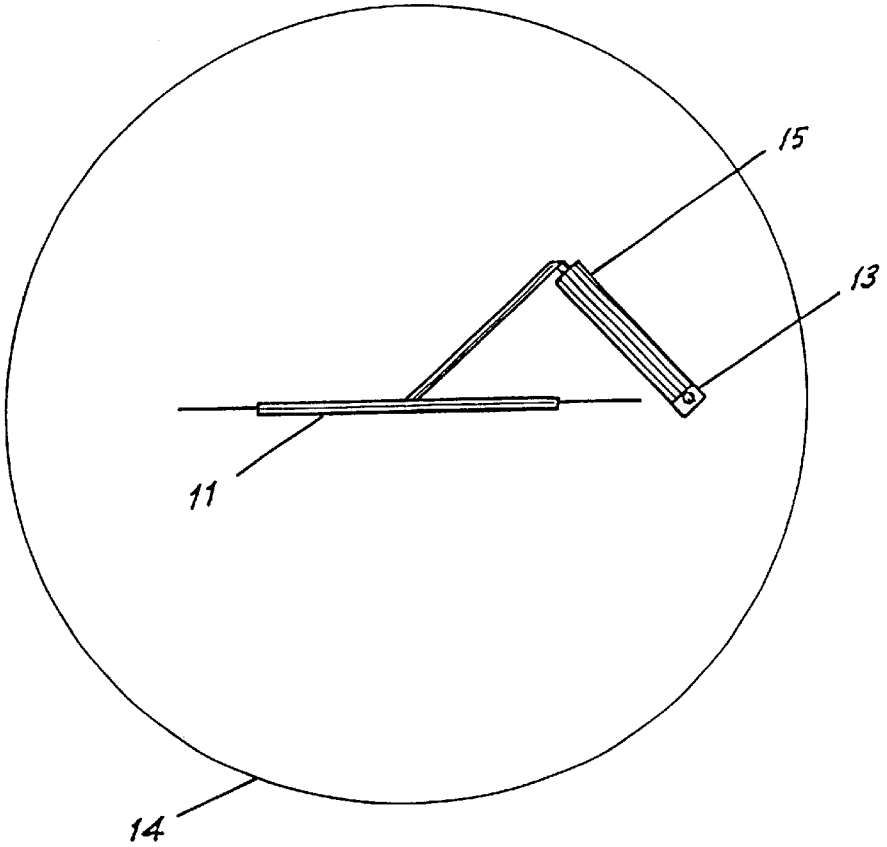

The AMD1 model (10) consists of a dual multitriangular monopole with omnidirectional radiation diagram in the horizontal plane. The multitriangular structure comprises a copper sheet which is 2 mm thick and with an outer perimeter in the form of an equilateral triangle which is 11.2 cm high. A bore (18), which is also triangular, is formed in said triangular structure that is 36.6 cm high and having a reversed position relative to the main structure, giving rise to three triangles (19–20) mutually linked by the vertexes thereof as shown in FIGS. 1 and 3. The larger triangle (20) of these three triangles is also equilateral and is 75.4 cm high.

The multitriangular element (11) is mounted perpendicular to a circular ground plane (14) made of aluminium having a 22 cm diameter. The structure is supported with one or two dielectric posts, so that the far distant vertex from the central hole of the structure is located at a 3.5 mm height relative to the center of the circular ground plane (14). Both points, the vertex of the antenna and the center of the ground plane (14), form the terminal where the connection network (12) will be connected. In that point, the antenna (10) becomes resonant in the central frequencies of the GSM and DCS bands, having typical impedance of 250 Ohm. The space between the ground plane (14) and the radiating element (11) will depend on the type of connection network (12) to be used.

The connection network (12) and the adaptation network (15) is a broadband impedance transformer comprising several sections of transmission lines. In the particular case described herein, the network is formed by two sections of transmission line of an electrical length that corresponds to a quarter of the wavelength in the frequency of 1500 MHz. The characteristic impedance of the transmission line closer to the antenna is 110 Ohm, whilst the second line has a characteristic impedance of 70 Ohm. A particular version of said connection network is a microstrip-type line on a rigid foam type substrate that is 3.5 mm thick and 62.5×2.5 mm size in the first section and 47×8 mm size in the second one (dielectric permitivity is 1.25). The network end opposed to that of the antenna is connected to a 50-Ohm axial connector mounted perpendicular to the ground plane from the back surface. An N-type connector (customarily used in GSM antennas) will be preferably used. The antenna is provided with a single connector for both bands. Its conversion into a two-connector antenna (one for each band) will be made possible by adding a conventional diplex network.

Optionally, the antenna can be covered with a dielectric radome being transparent to electromagnetic radiation, which function is to protect the radiating element as well as the connection network from external aggressions.

Different conventional techniques can be used for a roof fixing, e.g. by means of three holes formed in the perimeter of the horizontal plane for housing corresponding fixing screws.

Figure 4:
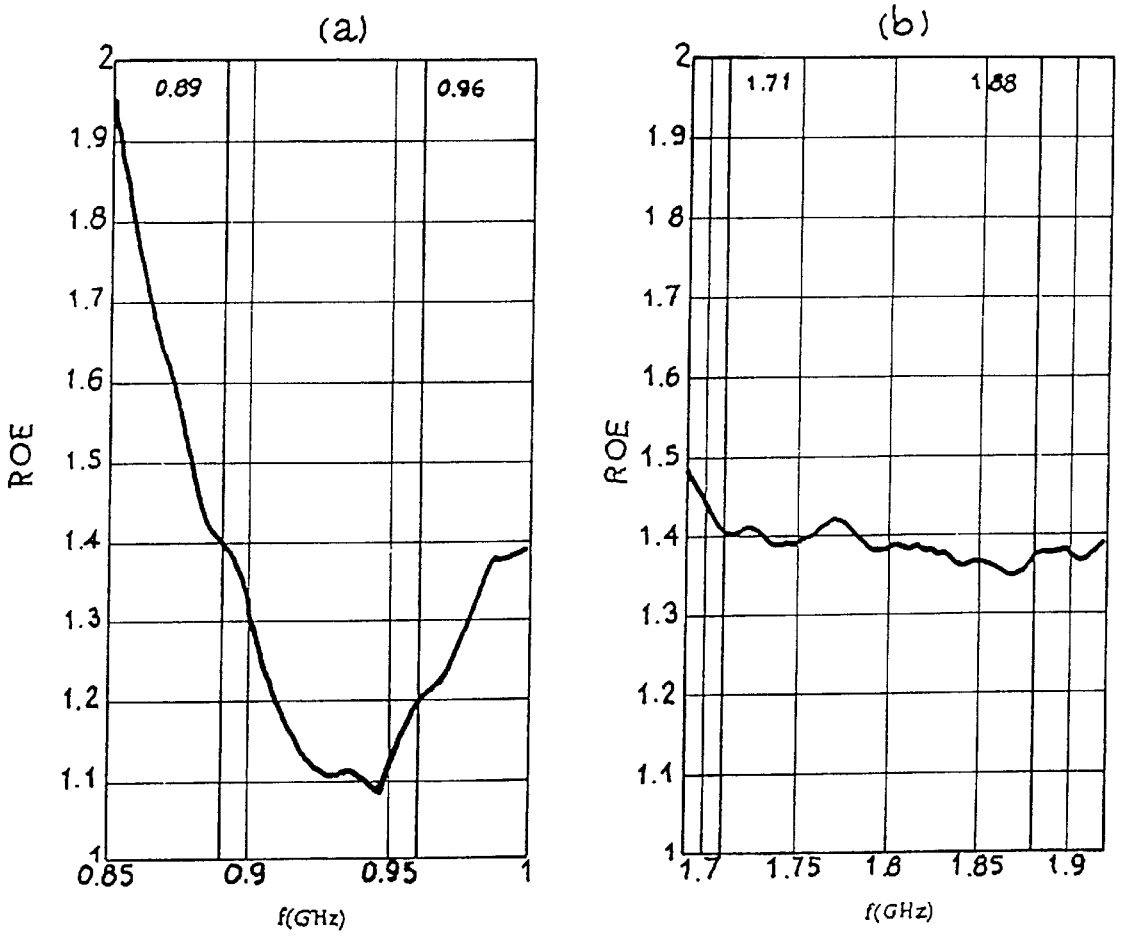
FIG. 4 summarises the radioelectric performance of the antenna in the GSM and the DCS bands (graphs (a) and (b), respectively).

Standing wave ratio ROE in both GSM and DCS bands is shown in FIG. 4, where ROE is 1.5 in the whole band of interest.

Figure 5:
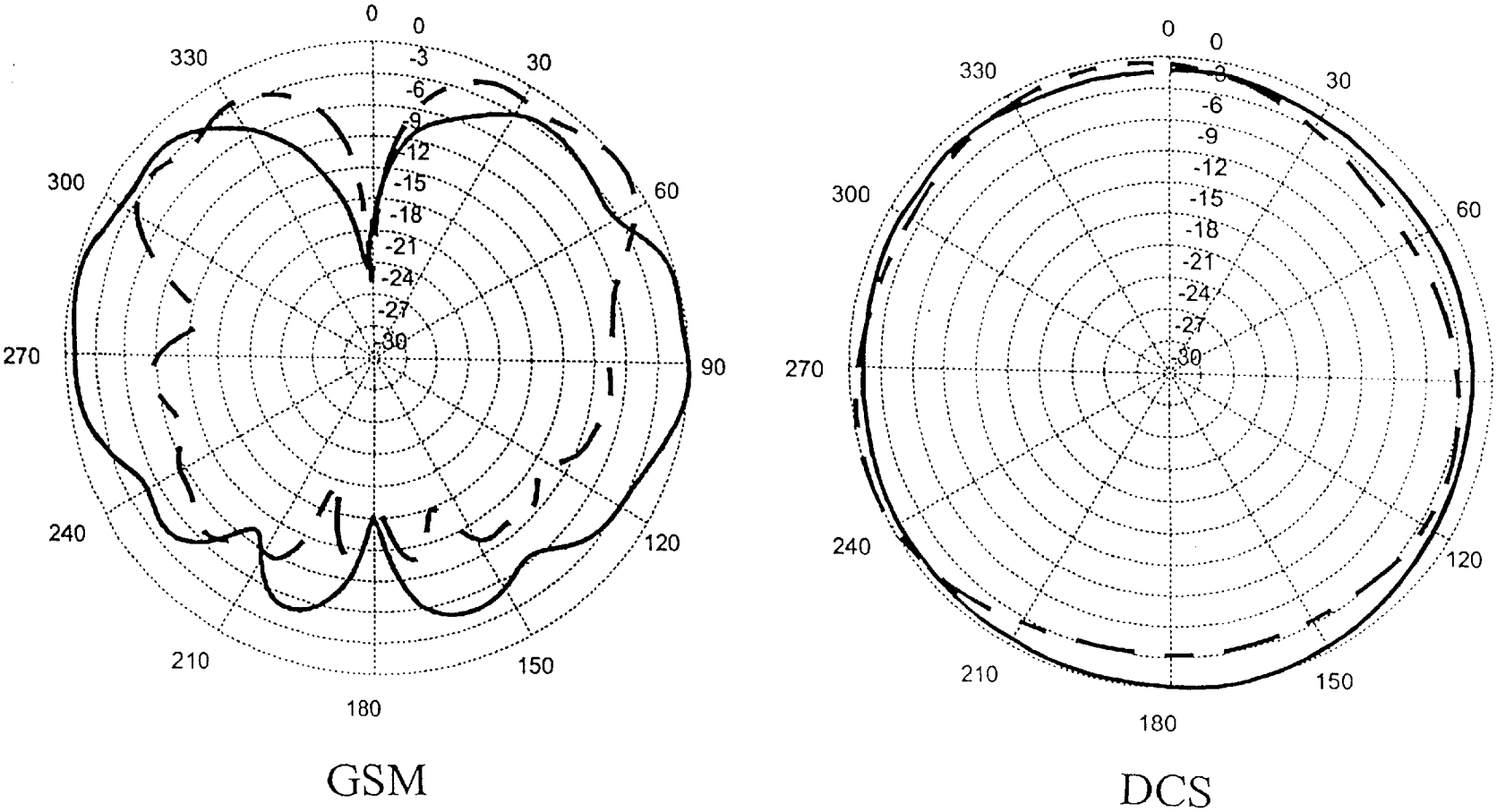
FIG. 5 is a typical radiation diagram in the GSM and DCS bands, both of them keeping the bilobate structure in the vertical plane and a omnidirectional distribution in the horizontal plane.

Two typical radiation diagrams are shown in FIG. 5. It can be seen an omnidirectional performance in the horizontal plane and a typical bilobate diagram in the vertical plane, the typical directivity of the antenna being 3.5 dBi in the GSM band and 6 dBi in the DCS band. The fact should be stressed that the performance of the antenna is similar in both bands (both in ROE and in diagram), this turning the antenna into a dual antenna.

The AMD2 model (17) consists of a dual multitriangular patch-type antenna with a sectorial radiation diagram in the horizontal plane.

Figure 6:
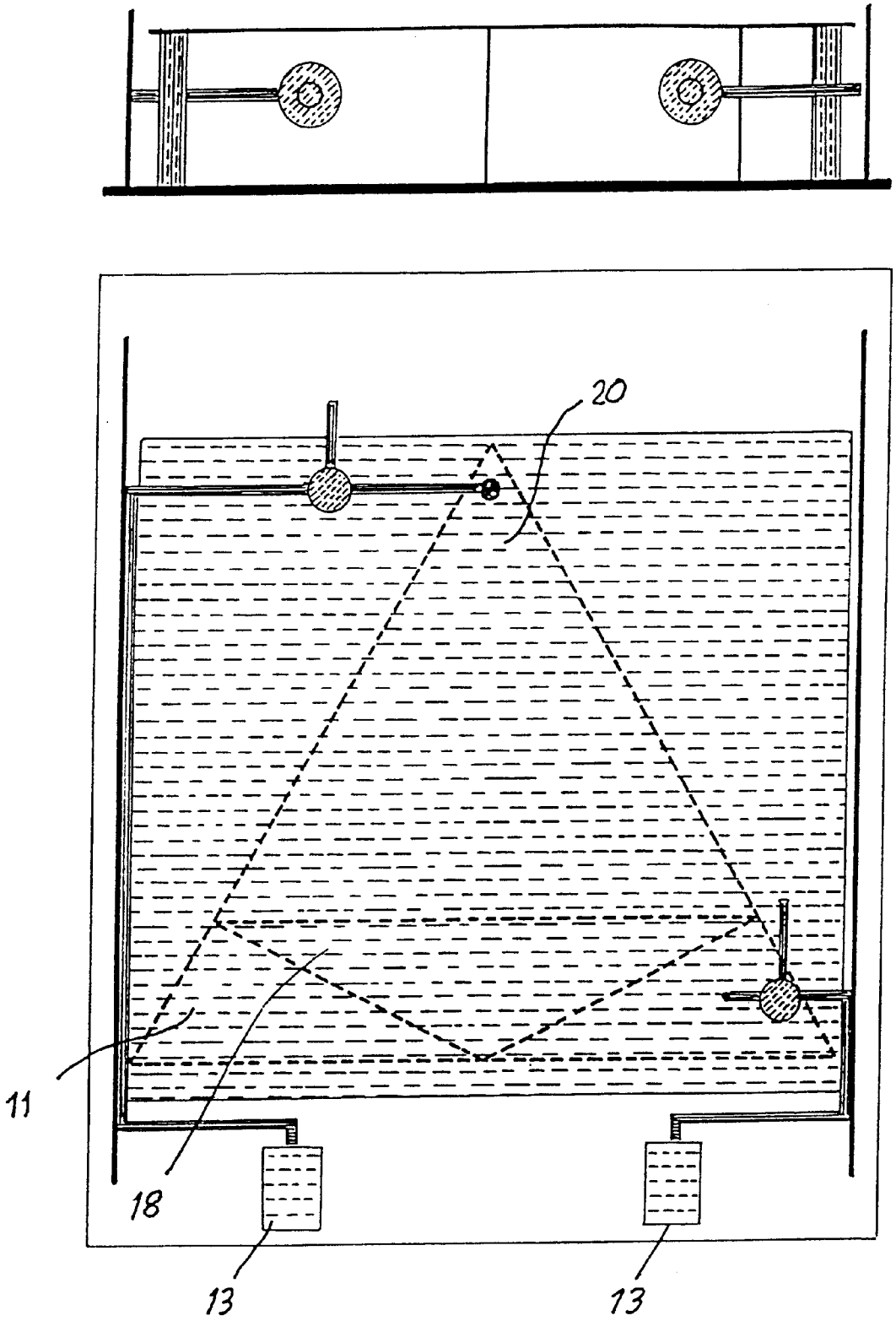
FIG. 6 is a specific embodiment of the sectorial dual multitriangular antenna (AMD2).

The multitriangular structure (11) (the patch of the antenna) comprises a copper sheet printed on a circuit board made up of standard fiber glass, with an outer perimeter in the form of an equilateral triangle that is 14.2 cm high. Said triangular structure (11) is printed keeping a central triangular area (18) free of metal and being 12.5 cm high having a reversed position relative to the main structure. The structure thus formed comprises three triangles mutually linked by the vertexes thereof, see FIG. 6. The larger triangle (20) of these three triangles is also equilateral and is 10.95 cm high, see FIG. FIG. 2.

The multitriangular patch (11) is mounted parallel to a rectangular ground plane (14) made of aluminium that is 20×15 cm. The space between the patch and the ground plane is 3.5 cm that is maintained by four dielectric spacers working as a support member (not depicted in FIG. 2). In the two sides of the ground plane (14) are mounted rectangular cross-section flanges being 4 cm high which make the radiating beam narrower in the horizontal plane.

The antenna connection is carried out in two points. The first one is located in the bisector at a distance of 16 mm from the vertex and forms the supply point in the DCS band. The second one is located at any of the two symmetric triangles of the structure, keeping a space of 24 mm in the horizontal direction relative to the outer vertex, and a space of 14 mm relative to the larger side in the vertical direction, forming the supply point in the GSM band.

The connection to these points is carried out by means of a conductor wire having a cross-section of 1 mm, mounted perpendicular to the patch. At the point of GSM, one end of the wire is welded to the patch and the other end to the circuit which interconnects the radiating element and the access connector. In the DCS band, the wire comprises, for example, the central conductor of a 50 Ohm coaxial cable, which outer conductor is connected to the outer surface of the ground plane still leaving a surrounding circular crown of air that is 4.5 mm in diameter, so that the conductor wire and the patch will never come into direct contact. In this case, coupling between the conductor wire and the patch is a capacitive coupling. To keep the wire centered into the hole of the patch, a rigid foam rectangle (16) with a low dielectric permitivity (permitivity=1.25) can be stuck in the inner surface of the patch where a hole is formed that is 1 mm in diameter which will guide the conductor to the center of the patch hole. In this case, said hole will widen from 4.5 mm to 5.5 mm to compensate for an increase in the capacitive effect provided by the foam rectangle (16). In case of using other materials with a dielectric permitivity different from 1.25, the hole has to be properly resized so as to adjust the adaptation zone to the DCS band.

Interconnection between the GSM supply point and the antenna access connector (13) will be carried out through an adaptation-transformation impedance network (15), see FIG. 3. This network basically consists of a transmission line having an electrical length that corresponds to a quarter of the wavelength in the frequency of 925 MHz and having characteristic impedance of 65 Ohm. In one end, the line is welded to the conductor wire which is connected to the multitriangular patch and it is welded at the opposite end to a N-type connector (13) mounted in the back surface of the ground plane. Optionally, the connector (13) can be replaced with a transmission line tract of 50 Ohm (e.g., a semirigid coaxial cable) along with a connector at the opposite end, whereby permitting the N-connector position to be independent on the location of the transformer network.

Another particular version of the adaptation network consists of a 50 Ohm transmission line with a suitable length such as to have a conductance of 1/50 Siemens (e.g. a microaxial-type cable), where a stub is inserted in parallel (another 50 Ohm line of a suitable length) which would cancel the remaining reactance at the first line output.

To increase isolation between the GSM and DCS connectors, a parallel stub will be connected at the DCS wire connector base having an electrical length equal to a half wavelength in the central DCS frequency and being finished in open circuit. Analogously, at the base of the GSM wire a parallel sub finished in open circuit will be connected having an electrical length slightly exceeding a quarter wavelength in the GSM band central frequency. Such stub provides capacitance in the connection base that can be adjusted to compensate for the remaining inductive effect of the conductor wire. Furthermore, said stub has highly poor impedance in the DCS band, which helps to increase isolation between connectors in said band.

Figure 7:
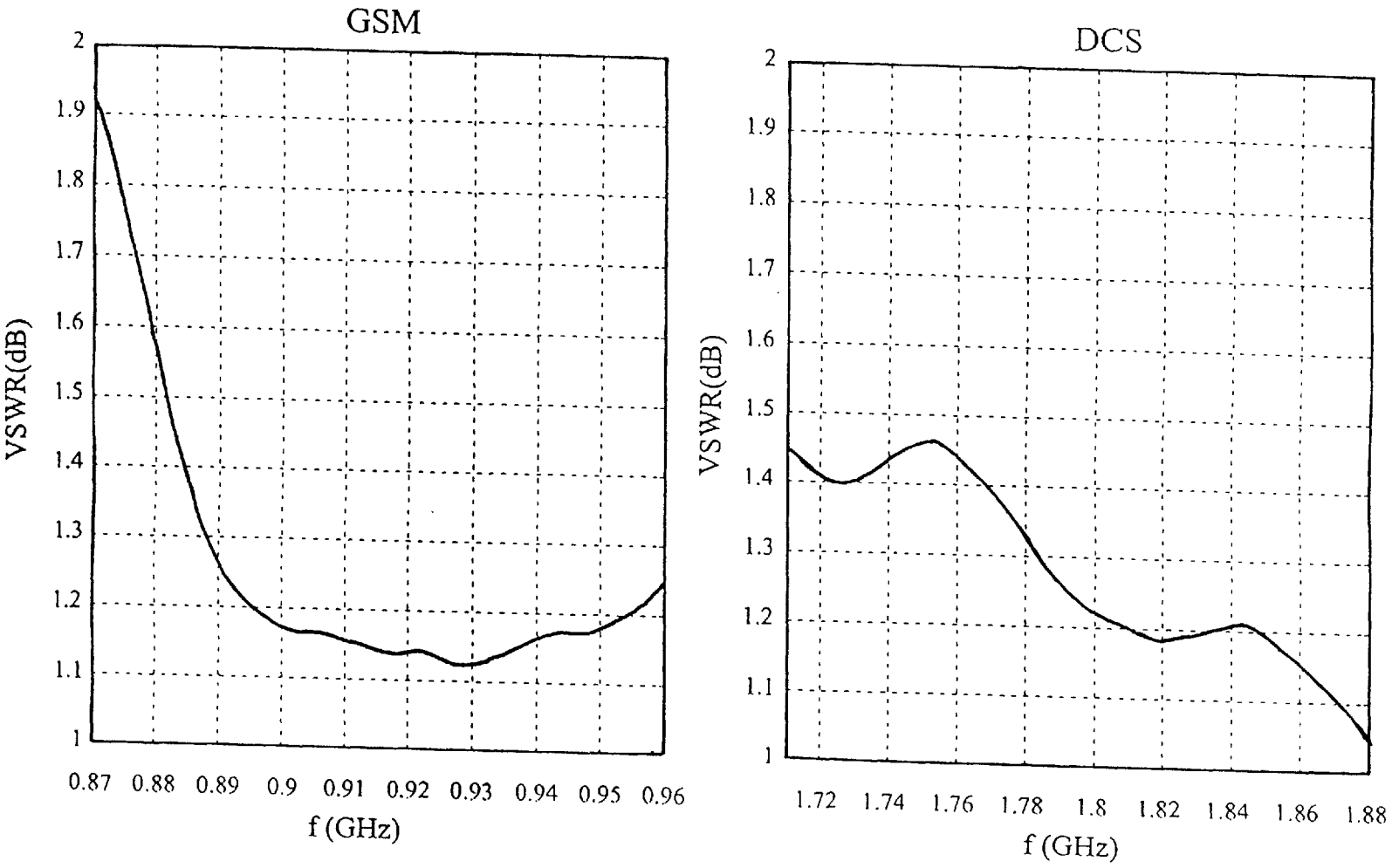
FIG. 7 shows the typical radioelectric performance of a specific embodiment of a dual multitriangular antenna where it can be seen the ROE in GSM and DCS, typically lower than 1.5.
Figure 8:
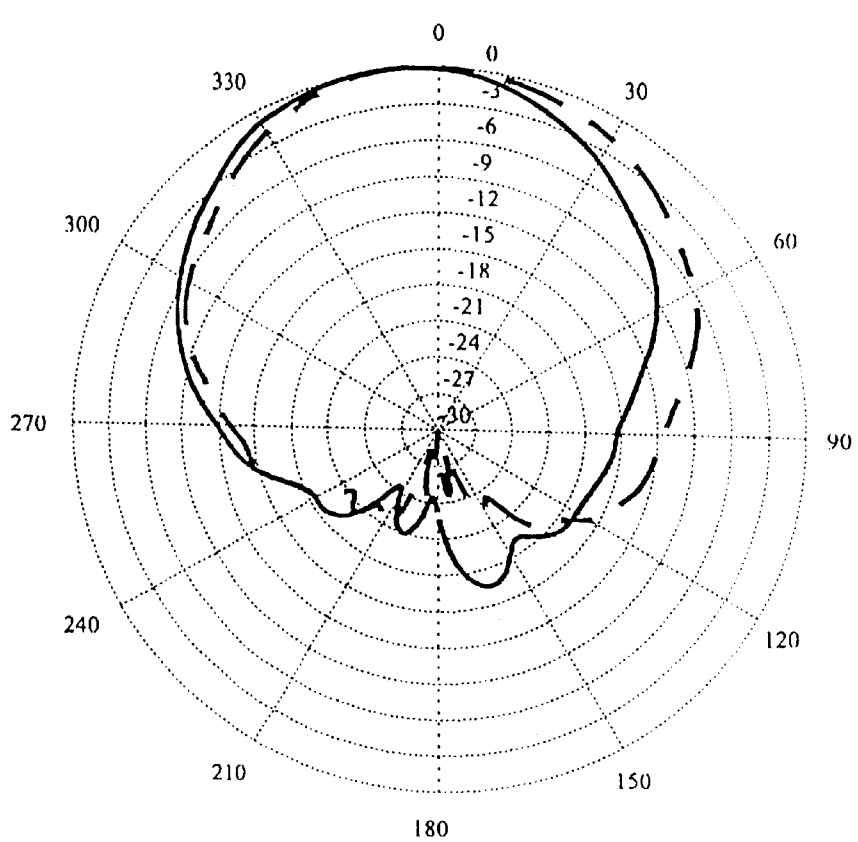
FIG. 8 shows the radiation diagrams of both types of antenna, GSM and DCS.
Figure 8:
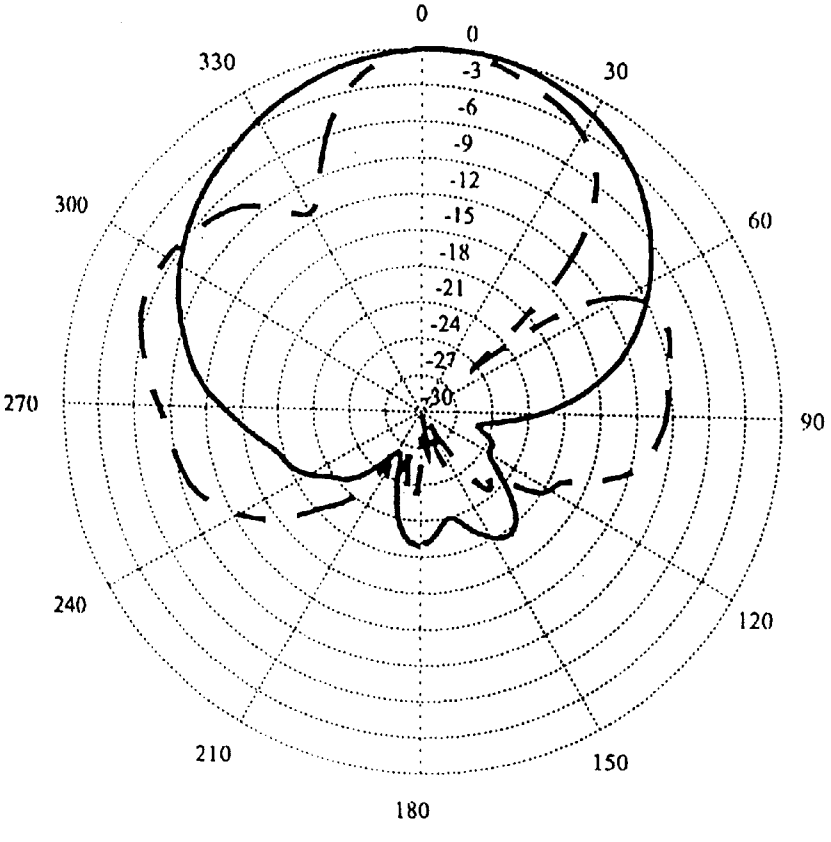

In FIGS. 7 and 8 the typical radiolectric performance of this specific embodiment of the dual multitriangular antenna is shown. In FIG. 7, ROE in GSM and DCS is shown, typically lower than 1.5. The radiation diagrams in both of them are shown in FIG. 8. It can be seen clearly that both antennas are radiating by means of a main lobe in the perpendicular direction to the antenna and that in the horizontal plane both diagrams are sectorial-type, having a typical beam width dimension of 65° at 3 dB. The typical directivity in both bands is 8.5 dB.

Once having been sufficiently described what the present patent application consists in accordance to the enclosed drawings, it is understood that any detail modification can be introduced as appropriate, provided that variations may alter the essence of the invention as summarised in the appended claims.

What is claimed is:

1. Dualmultitriangular,non-fractal antennas for base stations of GSM and DCS band cellular telephony systems; for providing radioelectric coverage, said antennas comprising a radiating element made out of a conductive or superconductor material, a connection and a ground plane, the radiating element being multitriangle shaped, and having a structure with an outer perimeter in the form of a triangle comprising a number of triangles linked by the vertexes thereof.

2. The dual multitriangular antennas as claimed in claim 1, characterised in that the multitriangular element comprises three triangles linked by the vertexes thereof.

3. The dual multitriangular antennas as claimed in claim 1, characterised in that the multitriangular element is mounted perpendicular to the ground plane in a monopole type configuration.

4. The dual multitriangular antennas as claimed in claim 3, characterised in that a corresponding antenna radiation diagram is omnidirectional in the horizonal plane and has a bilobate section in the vertical plane in the GSM and DCS bands.

5. The dual multitriangular antennas as claimed in claim 3, characterised in that the antenna is mounted horizontal to the ground plane and parallel to the ground to provide coverage with its omnidirectional diagram to one GSM and DCS system cell.

6. The dual multitriangular antennas as claimed in claim 3, characterised in that the multitriangular element has an outer perimeter in the form of an equilateral triangle that is about 11.2 cm high and in that a largest one of the three triangles forming the structure is an equilateral triangle that is about 8 cm high.

7. The dual multitriangular antennas as claimed in claim 1, characterised in that the multitriangular element comprises three triangles and it is mounted parallel to the ground plane in a patch like antenna configuration.

8. The dual multitriangular antennas as claimed in claim 7, characterised in that the main beam of the antenna faces the perpendicular direction to the ground plane and it has a sectorial shape in the horizontal plane with a beam width of about 65° at 3 dB in the GSM and DCS bands.

9. The dual multitriangular antennas as claimed in claim 8, characterised in that the antenna is vertically mounted with the ground plane being fixed to a wall, a pillar or a vertical post to provide sectorial coverage to one cellular telephony GSM and DCS system cell.

10. The dual multitriangular antennas as claimed in claim 7, characterised in that an outer perimeter of the multitriangular element is an equilateral triangle that is about 14 cm high and in that a largest one of the three triangles forming the structure is an equilateral triangle about 11 cm high.

11. The dual multitriangular antennas as claimed in claim 7, characterised in that the connection to the antenna is provided in two different points for GSM and DCS, the antenna being provided with an independent connector for each band.

12. The dual multitriangular antennas as claimed in claim 1, characterised in that the antenna includes one connector for each of the GSM and DCS bands, through a standard diplex network.

13. The dual multitriangular antennas as claimed in claim 6, characterised in that the multitriangular element has an outer periphery in the form an equilateral triangle that has a height in the range of about 11.5 cm, plus or minus 10–20% and in that the largest one of the three triangles forming the structure is an equilateral triangle that has a height in the range of about 8 cm, plus or minus 10–20%, where the multitriangular element is conductive and is printed on a dielectric substrate having a refractive index greater than one.

14. The dual multitriangular antennas as claimed in claim 1, characterised in that the multitriangular element is loaded by an inductive loop.

15. The dual multitriangular antennas as claimed in claim 1, characterised in that a triangular tip of the vertex closer to the supply point is set to adjust a first band impedance.

16. The dual multitriangular antennas as claimed in claim 1, characterised in that a lower triangle of the multitriangular structure has a trapezoidal shape adjusting for a first band impedance.

* * * * *